United States Patent [19]

Kawai et al.

[11] 4,316,743

[45] Feb. 23, 1982

[54] HIGH DAMPING FE-CR-AL ALLOY

[75] Inventors: Mituo Kawai, Yokohama; Takashi Fujita, Ebina; Hideo Shirai; Masatoshi Nakagawa, both of Yokohama; Hiroshi Aee, Kawasaki, all of Japan

[73] Assignee: Tokyo Shibaura Electric Co., Ltd., Japan

[21] Appl. No.: 89,312

[22] Filed: Oct. 30, 1979

Related U.S. Application Data

[60] Division of Ser. No. 834,305, Sep. 19, 1977, abandoned, which is a continuation of Ser. No. 697,991, Jun. 21, 1976, abandoned, which is a continuation of Ser. No. 518,174, Oct. 25, 1974, abandoned.

[51] Int. Cl.[3] ..... C22C 37/10

[52] U.S. Cl. ..... 75/124; 75/125; 148/12 EA; 148/31; 148/37

[58] Field of Search ..... 75/124, 125; 148/12 EA, 148/31, 37

[56] References Cited

U.S. PATENT DOCUMENTS

| | | | |
|---|---|---|---|
| 312,864 | 5/1843 | Fahlenbach et al. | |
| 2,191,790 | 2/1940 | Franks | 75/126 |
| 2,703,355 | 3/1955 | Hagglund | 201/67 |
| 2,859,143 | 11/1958 | Nachman et al. | 148/2 |
| 2,987,394 | 6/1961 | Mueller et al. | 75/124 |
| 3,047,484 | 7/1962 | Stacy et al. | 204/193.2 |
| 3,068,094 | 12/1962 | Zackay et al. | 75/124 |
| 3,331,715 | 7/1967 | Bulina et al. | 148/142 |
| 3,645,722 | 2/1972 | Aulenbach et al. | 75/124 |
| 3,676,109 | 7/1972 | Cooper | 75/124 |
| 3,852,063 | 12/1974 | Nimmi et al. | 75/124 |
| 3,859,079 | 1/1975 | Giles et al. | 75/124 |
| 3,893,849 | 7/1975 | Brickner | 75/124 |

FOREIGN PATENT DOCUMENTS

| | | | |
|---|---|---|---|
| 1145280 | 3/1969 | United Kingdom | 148/12 EA |

OTHER PUBLICATIONS

Case et al. (editors), Aluminum in Iron & Steel, Wiley, N.Y., 1953, pp. 297, 302–310, 315.

"Silent Steel", Newsweek, Mar. 24, 1975, p. 5.

James, D. W., Mat. Sc. & Engineering, 4 (1969), pp. 1–8.

Schetky et al., Machine Design, (1978) 202–206.

Constituent Elements in Steel and Cast Iron, Shieldalloy Corp., N.J., Jan. 1944.

Development of Silentalloy TM, Hidamet, Toshiba Rev., 99 (1975) 23–32.

Silentalloy (Toshiba), Toshiba Brochure (Partial Translation).

Silentalloy–SIA, Toshiba, (Metal Product Div. Publication).

*Primary Examiner*—Upendra Roy

*Attorney, Agent, or Firm*—Finnegan, Henderson, Farabow, Garrett & Dunner

[57] ABSTRACT

A metal alloy exhibiting exceptional damping characteristics consisting essentially of from 1 to 8% aluminum, 2 to 30% chromium, and including up to 0.02% carbon with the balance being essentially iron. The alloy is heat treated at a temperature in the range of 700° to 1200° C. to provide the alloy with the enhanced damping characteristics.

19 Claims, 1 Drawing Figure

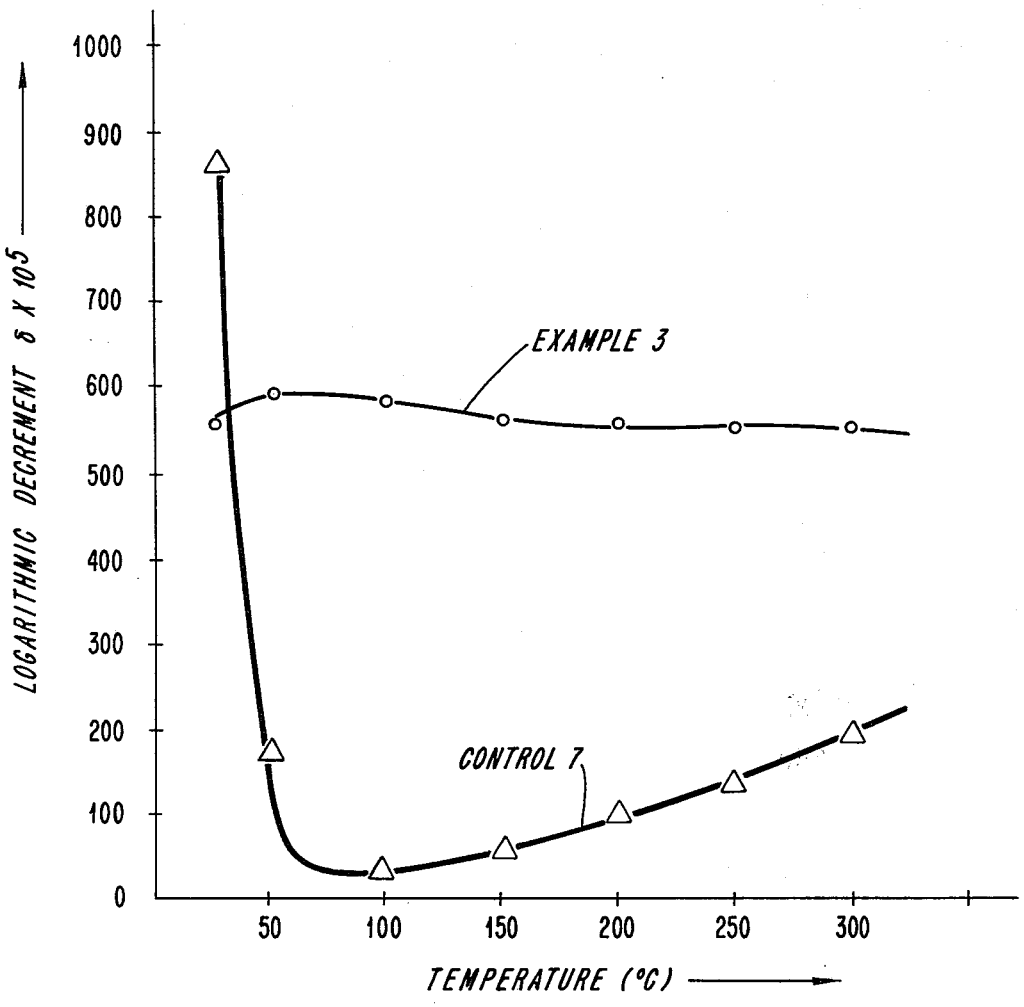
1000
900
800
700
600
500
400
300
200
100
0
LOGARITHMIC DECREMENT δ X 10-5
EXAMPLE 3
CONTROL 7
50
100
150
200
250
300
TEMPERATURE (°C)

HIGH DAMPING FE-CR-AL ALLOY

This is a divisional application of U.S. Patent application Ser. No. 834,305, filed Sept. 19, 1977, now abandoned, which is a continuation of U.S. Patent application Ser. No. 697,991, filed June 21, 1976, now abandoned, which is a continuation of U.S. Patent application Ser. No. 518,174, filed Oct. 25, 1974, now abandoned.

BACKGROUND OF THE INVENTION

This invention relates to a high damping alloy which is capable of, when used as parts for a compression and the other devices, absorbing vibrations and noises generated from these devices. Noises have recently been regarded as one of major public nuisances. Therefore, attempt has been made to reduce noises as generated from a variety of devices. As one method for absorbing vibrations and noises, a high damping material is employed for such a purpose. As such a high damping material, plastics has been used. Since, however, plastics is lower in its mechanical strength and heat resistance, the range of application is restricted with the resultant disadvantage. To avoid this drawback, a metal material having a high damping capability has been desired. Recently, a copper alloy including 40–60% of Mn has been developed. With such an Mn-Cu alloy, however, a high damping capability is exhibited at a temperature close to room temperature, but the transitiin temperature of the damping capability is low i.e. 50° to 80° C. and the damping capability is suddenly lowered at a temperature higher than this transition temperature. For this reason, the alloy is not suitable as a damping member, such as a valve seat for a compressor, which is subjected to a heat of about 100° C.

SUMMARY OF THE INVENTION

It is accordingly the object of this invention to provide a high damping alloy, and a method for manufacturing the same, which exhibits a high damping capability even at a high temperature, as well as exhibits a great mechanical strength, excellent workability and excellent anti-corrosivity.

According to one aspect of this invention, there is provided a high damping alloy comprising 1 to 8% by weight of Al, 2 to 30% by weight of chromium, Fe constituting the balance, and impurities as traces. In another aspect of this invention there is provided a method for manufacturing a high damping alloy which comprises melting the above-mentioned composition for the high damping alloy and, after subjected to forging, casting, rolling etc., heat treating it at a temperature of 700°–1200° C.

BRIEF DESCRIPTION OF THE DRAWING

FIGURE is a graph representing a comparison in the temperature characteristic of a damping capability between this invention and the prior art.

DESCRIPTION OF THE PREFERRED EMBODIMENT

A high damping alloy according to this invention comprises 1 to 8%, preferably 2 to 4%, by weight of Al; 2 to 30%, preferably 5 to 20%, by weight of Cr; and Fe constituting the balance. As far as the object of this invention is not substantially affected, the high damping alloy may further include the other metals or impurities in small quantities. For the de-oxidation and de-sulfurization purposes, for example, less than 0.5% by weight of Si and less than 1.0% by weight of Mn may be added to the high damping alloy. For the purpose of improving machinability, S, Pb and Ca may be added to the high damping alloy, while for the purpose of enhancing anti-corrosivity, Ni, Cu etc. may be added to the high damping alloy in small amounts, for example, in an amount of less than 1% by weight.

There will now be explained the reason why the components of the high damping alloy are so restricted.

Al constitutes an essential element as required in enhancing a damping capability. If it is less than 1%, there is obtained no sufficient damping capability as required from the practical viewpoint and if it is greater than 8%, the damping capability is lowered and a plastic workability is deteriorated.

If Cr is less than 2%, a damping capability is not improved. On the other hand, if it is more than 30%, anti-corrosivity is further enhanced, but the damping capability is lowered.

Si and Mn are added as a de-oxidizing and de-sulfurizing agent to the high damping alloy. If Si and Mn exceed 0.5% and 1%, respectively, mechanical properties such as ductility are undesirably deteriorated.

Except for the above-mentioned component elements, C, P etc. may be included, as impurities, in the high damping alloy. The content of C, P etc. is preferably less than 0.5%.

A method for manufacturing a high damping alloy according to this invention comprises melting the above-mentioned composition for the alloy, subjecting it to casting, forging, rolling etc., and, after heat treating at a temperature of 700° to 1200° C., preferably 900° to 1050° C., slowly cooling it. If the above-mentioned heat treating temperature is less than 700° C., no satisfactory damping capability is obtained. If, on the other hand, it is more than 1200° C., a high cost results. In addition, the grain size is coarsened and the machanical properties are deteriorated.

This invention will be explained by reference to Controls.

TABLE I

| Sample | Component (weight %) Al | Cr | Si | Mn | C | Other metal component | Fe | Heat treatment | Damping capability (Room temperature) |
|---|---|---|---|---|---|---|---|---|---|
| Example 1 | 1.03 | 2.98 | 0.22 | 0.19 | 0.012 | — | Bal. | 700° C. × 1H | 371 |
| Example 2 | 1.00 | 8.10 | 0.19 | 0.21 | 0.009 | — | Bal. | " | 420 |
| Example 3 | 3.01 | 3.13 | 0.21 | 0.21 | 0.013 | — | Bal. | " | 553 |
| Example 4 | 3.02 | 7.91 | 0.18 | 0.21 | 0.011 | — | Bal. | " | 568 |
| Example 5 | 2.94 | 15.11 | 0.22 | 0.18 | 0.009 | — | Bal. | " | 394 |
| Example 6 | 5.03 | 7.92 | 0.20 | 0.20 | 0.008 | — | Bal. | " | 571 |
| Example 7 | 4.98 | 15.20 | 0.21 | 0.21 | 0.012 | — | Bal. | " | 568 |
| Example 8 | 1.08 | 28.3 | 0.21 | 0.20 | 0.012 | — | Bal. | " | 483 |

TABLE I-continued

| Sample | Component (weight %) Al | Cr | Si | Mn | C | Other metal component | Fe | Heat treatment | Damping capability (Room temperature) |
|---|---|---|---|---|---|---|---|---|---|
| Example 9 | 3.46 | 9.85 | — | — | 0.014 | — | Bal. | " | 572 |
| Example 10 | 3.39 | 9.90 | 0.18 | — | 0.014 | — | Bal. | " | 555 |
| Example 11 | 3.51 | 9.88 | — | 0.19 | 0.017 | — | Bal. | " | 566 |
| Example 12 | 2.96 | 10.80 | 0.20 | 0.14 | 0.016 | S = 0.07 | Bal. | " | 491 |
| Example 13 | 3.03 | 11.00 | 0.18 | 0.18 | 0.015 | Pb = 0.56<br>Ca = 0.06 | Bal. | " | 488 |
| Example 14 | 3.00 | 11.55 | 0.22 | 0.20 | 0.019 | Cu = 0.81 | Bal. | " | 456 |
| Example 15 | 2.99 | 10.96 | 0.14 | 0.19 | 0.015 | Ni = 0.93 | Bal. | " | 448 |
| Example 16 | 2.11 | 6.56 | 0.26 | 0.21 | 0.020 | — | Bal. | 1000° C. × 1H | 1180 |
| Example 17 | 3.19 | 11.84 | 0.19 | 0.23 | 0.017 | — | Bal. | " | 1830 |
| Example 18 | 1.07 | 20.36 | — | 0.19 | 0.019 | — | Bal. | " | 870 |
| Example 19 | 3.19 | 11.74 | 0.19 | 0.23 | 0.017 | — | Bal. | 1200° C. × 1H | 1600 |

As is evident from the column of Table I showing the weight percent carbon in Examples 1–19, each of the examples include some carbon in an amount ranging up to a maximum of 0.02 for Example 16. It is also evident from TABLE I that the damping capability at room temperature of all the alloys in the examples is in excess of 300.

TABLE II

| Sample | Component (weight %) Al | Cr | Si | Mn | C | Ni | Mo | Cu | Fe | Heat treatment | Damping capability (Room temperature |
|---|---|---|---|---|---|---|---|---|---|---|---|
| Control 1 | 1.01 | — | 0.23 | 0.18 | 0.013 | — | — | — | Bal. | 700° C. × 1H | 162 |
| Control 2 | 3.03 | — | 0.20 | 0.21 | 0.008 | — | — | — | Bal. | " | 385 |
| Control 3 | 3.04 | — | 0.23 | 0.19 | 0.011 | — | — | — | Bal. | " | 158 |
| Control 4 | — | — | 0.21 | 0.20 | 0.012 | — | — | — | Bal. | " | 153 |
| Control 5 | — | — | — | 0.5 | 0.001 | 46.6 | — | — | Bal. | 1200° C. × 1H→250° C./H →300° C. →furnace cooling | 261 |
| Control 6 | — | — | — | 0.42 | 0.001 | 78.8 | 4.82 | — | Bal. | 1080° C. × 2H →furnace cooling →600° C.–100° C./H →300° C. →furnace cooling | 86 |
| Control 7 | 3.02 | — | — | 40.8 | — | — | — | Bal. | — | 690° C. × 1H →water cooling →200° C. × 12H →440° C. × 1H | 865 |
| Control 8 | — | — | 0.23 | 0.70 | 0.41 | — | — | — | Bal. | nil | 10 |

A plate about 1 mm in thickness was obtained by melting the alloy as shown in Table I and subjecting it to casting, forging and rolling treatments. Sample of about 10 mm in width × about 100 mm in length was cut from the plate. The sample was subjected to an annealing treatment and then a bending vibration was imparted to the sample and a logarithmic decrement $\delta$ was determined at room temperature. Since the logarithmic decrement is greatly dependent upon an amplitude, a vibration having a predetermined amplitude was imparted to all the sample and the determination was made, the results of which are shown in Table I. In Table I, the damping capability is indicated by relative values as obtained when the logarithmic decrement value of a cold rolled material of S40C (a carbon steel under JIS) of Control 8 is 10.

From Table II it will be appreciated that the high damping alloy according to this invention has an excellent damping capability as compared with the other Controls except for Control-7. As will be evident from Table II the Examples 16 to 18 heat-treated at a temperature of 1000° C. exhibit a damping capability about three times higher than that of the Examples which are heat-treated at a temperature of 700° C.

With regard to Example-3 and Control-7 the temperature characteristic of a damping capability which ranges from room temperature to 300° C. was determined according to the abovementioned method. FIG. 1 shows a relation between the damping capability and the temperature. As will be appreciated from the FIGURE, with an Mn-Al-Cu alloy of Control-7 a damping capability at room temperature is greater than that of the high damping alloy according to this invention, but it is suddenly decreased at a temperature of about 70° C. In contrast, the high damping alloy of Example-3 still retains its high damping capability, even if the temperature is varied from room temperature to about 300° C., and, therefore, has an excellent temperature characteristic. The same may be said of the other Examples.

The tensile strength of the high damping alloy according to this invention is, in the case of Example-3, 56.4 kg/mm$^2$, while the tensile strength of Control-6 is 45.3 kg/mm$^2$. From this it will be understood that the high damping alloy according to this invention has a greater mechanical strength.

Test was conducted by spraying a salt water to Examples 4 and 5 and Controls 1 and 2. The salt water having a 5% concentration was sprayed, at an angle of about 45° and at a temperature of 35°±2° C. and a pressure of 0.7 to 0.8 kg/cm$^2$, onto each sample. Then, each sample was allowed to stand for a period of 16 hours. As a result, a red rust was formed deep over the whole surface of Controls 1 and 2. In contrast, Examples 4 and 5 are partially tarnished. From this it will be appreciated that the high damping alloy according to this invention has an excellent anti-corrosive property as compared with the Controls.

As above-mentioned, the high damping alloy according to this invention exhibits a greater damping capability even at high temperature and, in addition, has also an excellent plastic workability, excellent anti-corrosivity, and greater mechanical strength. This invention, therefore, provides a material which is very useful from the industrial viewpoint.

What we claim is:

1. A metal alloy consisting essentially of from 1 to 8% aluminum, 2 to 30% chromium, and including up to 0.02% carbon, the balance being essentially iron, said alloy having been heat treated at a temperature in the range of from 700° to 1200° C. to provide said alloy with enhanced damping characteristics.

2. The composition of claim 1 wherein said alloy further includes about 0.05% by weight silicon.

3. The composition of claim 1 wherein said alloy further contains less than 1% manganese.

4. The composition of claim 1 wherein said alloy contains less than 1% of an element selected from the group consisting of sulphur, lead and calcium.

5. The composition of claim 1 wherein said alloy further contains nickel or copper in an amount less than 1%.

6. A metal alloy consisting essentially of from 2 to 4% aluminum, 5 to 20% chromium, including up to 0.02% carbon with the balance being essentially iron, said alloy having been heat treated at a temperature in the range of from 700° to 1200° C. to provide said alloy with enhanced damping characteristics.

7. The composition of claims 1 or 6 wherein said heat treatment is in the range of from 900° to 1050° C.

8. The alloy of claim 7 wherein said heat treatment of said alloy results in said alloy having a relative damping capability at room temperature (δ) in excess of 300.

9. A method of making a metal article of enhanced damping characteristics comprising the steps of: forming said article of a metal alloy consisting essentially of from 1 to 8% aluminum, 2 to 30% chromium, and including up to 0.02% carbon, the balance being essentially iron; and heating said article at a temperature in the range of from 700° to 1200° C.

10. The method of claim 9 wherein said alloy contains from 2 to 4% aluminum, and 5 to 20% chromium.

11. The method of claim 9 wherein said article is heated in the range of from 900° to 1050° C. and then furnace cooled.

12. The method of claim 9 wherein said article has a relative damping capability at room temperature (δ) in excess of about 300.

13. An article comprised of a heat-treated metal alloy, said alloy consisting essentially of from 1 to 8% aluminum, 2 to 10% chromium, and including up to 0.02% carbon, the balance being essentially iron, said alloy having been heat-treated at a temperature in the range of from 700° to 1200° C., said heat-treated article being characterized by enhanced damping characteristics.

14. The article of claim 13 wherein said alloy heat treatment is in the range of from about 900° to 1050° C.

15. An article of enhanced damping characteristics, said article being comprised of a heat-treated metal alloy having a relative damping capability at room temperature (δ) in excess of about 300, said alloy consisting essentially of 1 to 8% aluminum, 2 to 30% chromium, up to 0.02% carbon, the balance being essentially iron, said damping capability being produced by heat treatment of said alloy at a temperature in the range of from 700° to 1200° C.

16. The article of claim 15 wherein said heat treatment is conducted in the range of from about 900° to 1050° C. for about 1 hour followed by slow cooling of said alloy from said range, wherein said article has a relative damping capability (δ) at room temperature greater than about 1000.

17. The article of claim 15 wherein said article retains its enhanced damping characteristics up to about 300° C.

18. The article of claims 14 or 16 wherein said alloy contains from 2 to 4% aluminum, and 5 to 20% chromium.

19. The article of claim 14 wherein said article has a relative damping capability at room temperature (δ) in excess of about 300.

* * * * *